United States Patent [19]

Shigemori et al.

[11] 3,949,200

[45] Apr. 6, 1976

[54] SYSTEM FOR SELECTIVE OPERATION OF MONEY DISPENSING MACHINE

[75] Inventors: Hideto Shigemori; Akio Ueba, both of Himeji, Japan

[73] Assignee: Glory Kogyo Kabushiki Kaisha, Japan

[22] Filed: Nov. 7, 1974

[21] Appl. No.: 521,920

Related U.S. Application Data

[63] Continuation of Ser. No. 301,252, Oct. 26, 1972, abandoned.

[30] Foreign Application Priority Data

Oct. 30, 1971 Japan ..... 46-86394

[52] U.S. Cl. ..... 235/92 SB; 235/92 CA; 235/92 R; 194/DIG. 26

[51] Int. Cl.[2] ..... G06M 3/08

[58] Field of Search ..... 235/92 SB, 92 CN, 92 CA; 221/94, 13, 9; 194/DIG. 9 B

[56] References Cited

UNITED STATES PATENTS 3,784,790 1/1974 Hatanaka et al. ..... 235/92 SB

*Primary Examiner*—Joseph M. Thesz

*Attorney, Agent, or Firm*—Holman & Stern

[57] ABSTRACT

A first detecting section is provided for detecting whether or not the operator has specified notes of particular denominations for dispensation of his desired amount of money and, if he has not, for delivering to a storage section an electrical signal representative of the amount of money to be dispensed in a minimum number of notes selected from those of various denominations prepared in the money dispensing machine. If he has, a second detecting section becomes operative to detect the specified denominations and to deliver to the storage section electrical signals representative of respective amounts of money to be dispensed in the notes of the specified denominations. The selective operation of either of these first and second detecting sections is ensured by a locking section which locks the operation of whichever is unrequired according to whether notes of particular denominations have been specified or not.

3 Claims, 4 Drawing Figures

SYSTEM FOR SELECTIVE OPERATION OF MONEY DISPENSING MACHINE

This is a continuation of application Ser. No. 301,252, filed Oct. 26, 1972, now abandoned.

BACKGROUND OF THE INVENTION

This invention relates to improvements in a money dispensing machine which releases a desired amount of money in notes of preselected denominations. More specifically, the invention relates to a system designed to make a money dispensing machine capable of correctly dispensing a desired amount of money either in notes of specified denominations or in a minimum number of notes available irrespective of faulty depression of its keys on the part of the operator. The invention also relates to a system designed to render the register of the money dispensing machine impervious to such faulty depression of the keys. Throughout this specification the currency under construction is exemplified by, and not limited to, the Japanese yen.

For causing this type of money dispensing machine to release a certain amount of money in a minimum number of notes selected from those of various denominations prepared therein, digit keys may be depressed to instruct the machine of the desired amount of money. However, in the case where dispensation in notes of particular denominations is desired, a function key must be depressed for each of these denominations before depressing the digit keys to indicate an amount of money to be dispensed in the notes of that particular denomination. Therefore, each time the keys are operated, the money dispensing machine must be able to discriminate whether it is required to release the amount of money in a mininum number of notes available or in notes of particular denomination, and must respond accordingly.

The depression of the keys directly affect the register of the money dispensing machine. When, for example, dispensation is required of 150,000 yen in 10,000-yen notes, 50,000 yen in 5,000-yen notes, 10,000 yen in 1,000-yen notes, and 5,000 yen in 500-yen notes, a key for specifying dispensation in the notes of 10,000-yen denomination must first be depressed, followed by the successive depressions of the digit keys for 1, 5, 0, 0, 0 and 0. The amount of 150,000 yen to be dispensed in 10,000-yen notes is thus set in the main register in the form of a shift register. A = function key is then depressed. The amounts to be replaced in 5,000-, 1,000- and 500-yen notes are successively registered in a similar manner. Each time the = function key is depressed, the succeedingly registered amount is added to the amount already set in the main register. The total amount of money to be dispensed is thus set in the main register, while the amounts to be dispensed in the notes of the respective denomonations are set in separate registers provided correspondingly for such denominations of notes prepared in the money dispensing machine.

It will now be apparent that if the operator forgets to depress the = function key during the above operation, the main register will record a wrong number. For example, if the operator forgets to depress the function key after depressing the digit keys for 150,000 yen to be dispensed in 10,000-yen notes and immediately thereafter depresses that digit keys for 50,000 yen to be dispensed in 5,000-yen notes, the main register will record an 11-figure number instead of the sum of 150,000 and 50,000.

Further, if two or more keys for specifying dispensation in notes of particular denominations are simultaneously depressed by accident, a corresponding number of denomination-specifying signals will be supplied simultaneously. It is very important to make the register of the money dispensing machine unaffected by such erroneous operation of the keys.

SUMMARY OF THE INVENTION

It is an object of the present invention to provide some improvements for enhancing the reliability of a money dispensing machine.

Another object of the invention is to provide such improvements in a money dispensing machine that each desired amount of money is released exactly in notes of specified denominations or in a mininum number of notes prepared in the machine irrespective of faulty depressions of its keys.

A further object of the invention is to provide such improvements in a money dispensing machine that its register makes correct registration of desired amount of money irrespective of faulty depressions of its keys.

The present invention provides, in a money dispensing machine capable of dispensing a desired amount of money either in notes of specified denominations or in a minimum number of notes prepared therein, the combination of storage means for storing information representative of a desired amount of money to be dispensed, first detecting means for detecting whether or not notes of particular denominations have been specified for dispensation and, if not, for delivering to the storage means information representative of the amount of money to be dispensed in a minimum number of notes available, second detecting means becoming operative when notes of particular denominations have been specified for dispensation to detect the specified denominations and to deliver to the storage means information representative of respective amounts of money to be dispensed in the notes of the specified denominations, and locking means for locking the operation of the first detecting means when notes of particular denominations have been specified for dispensation and for locking the operation of the second detecting means when notes of no particular denominations have been specified for dispensation.

The novel features which are considered characteristic of the present invention are set forth in the appended claims. The invention itself, however, together with additional objects and advantages thereof, will be best understood from the following description taken in conjunction with the accompanying drawings which illustrate, by way of example only, some preferred embodiments of the invention.

DETAILED DESCRIPTION

The system of this invention hereinafter described with reference to the accompanying drawings is adapted for a money dispensing machine capable of dispensing notes of 10,000-, 5,000-, 1,000- and 500-yen denominations. A preferred form of the system shown in FIG. 1 by way of example is broadly comprised of: a storage section A for storing or memorizing each desired amount of money to be dispensed; a first detecting section B for detecting whether or not the operator has specified, in a known manner, dispensation in notes of particular denominations and, if not, for delivering to the storage section A a signal representative of an amount of money to be dispensed in a minimum number of notes available; a second detecting section C for successively detecting particular denominations of notes to be dispensed in case the operator has specified them and for successively delivering to the storage section A signals respectively representative of amounts of money to be dispensed in the notes of the specified denominations; and a locking section D for locking the above described detecting operation of the second detecting section C whenever no particular denominations of notes have been specified for dispensation.

The storage section A in this exemplified system includes a storage circuit $M_{Tt}$ for storing or memorizing an amount of money to be dispensed in a minimum number of notes available and an amount of money to be dispensed in notes of 10,000-yen denomination, and three other storage circuits $M_{Ft}$, $M_{Ot}$ and $M_{Fh}$ for storing or memorizing amounts of money to be dispensed in notes of 5,000-, 1,000- and 500-yen denominations, respectively.

Figure 2:
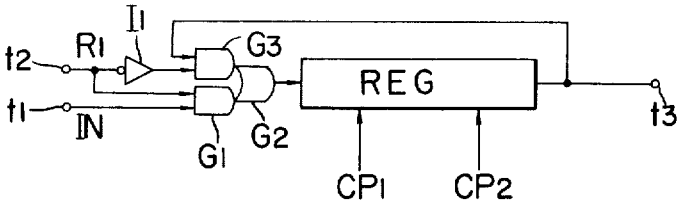
FIG. 2 is a schematic diagram showing in greater detail the configuration of each of storage circuits shown in FIG. 1.

As illustrated in more detail in FIG. 2, each of these storage circuits $M_{Tt}$, $M_{Ft}$, $M_{Ot}$ and $M_{Fh}$ is provided with a first input terminal $t_1$ to which is supplied an input IN representative of an amount of money to be dispensed and with a second input terminal $t_2$ to which is supplied an instruction signal RI from the second detecting section C. Thus, when the instruction signal RI in a high level is supplied to the second input terminal $t_2$, this signal is delivered to one of the input terminals of an AND gate $G_1$ to permit the input IN supplied to the first input terminal $t_1$ at the same time to be delivered to a shift register REG of, for example, six digits via the AND gate $G_1$ and an OR gate $G_2$. When, in this condition, the application of the instruction signal RI to the second input terminal $t_2$ has ceased so that the signal level at this second input terminal becomes low, an AND gate $G_3$ is opened via an inverter $I_1$. The information precedingly introduced into the shift register REG now starts circulating through the AND gate $G_3$ and the OR gate $G_2$. The so-called dynamic storage of the amount of money to be dispensed is thus completed.

As the amount of money to be dispensed is stored as aforesaid in the shift register REG and succeedingly starts circulating, the storage circuit $M_{Tt}$ in this particular embodiment of the invention delivers a high-level detection signal N to the locking section D when the digit place occupied by the first significant digit of that amount of money has been ascertained. The reference character $t_3$ in FIG. 2 denotes an output terminal of the shift register REG, and $CP_1$ and $CP_2$ denote clock inputs to the shift register.

Referring again to FIG. 1, the first detecting section B is of such configuration that high-level signals $S_{Tt}$, $S_{Ft}$, $S_{Ot}$ and $S_{Fh}$ which are produced when notes of 10,000-, 5,000-, 1,000- and 500-yen denominations have been specified for dispensation are supplied via a four-input OR gate $G_4$ and a two-input OR gate $G_5$ to the set terminal S of a flip-flop $FF_1$ to set the same. In its normal reset condition, the flip-flop $FF_1$ supplies a high-level $\overline{F}$ output to one of the input terminals of an AND gate $G_6$, which AND gate is opened when further supplied with a high-level timing signal $P_1$ through a terminal $T_1$. Thus, the $\overline{F}$ output of the flip-flop $FF_1$ is supplied as the instruction signal RI, to the storage circuit $M_{Tt}$ of the storage section A via the AND gate $G_6$ and an OR gate $G_7$. However, when the flip-flop $FF_1$ has been set as above stated so that its $\overline{F}$ output level becomes low, the instruction signal $RI_1$ is not supplied through the AND gate $G_6$. Further, when the flip-flop $FF_1$ has been reset so that its $\overline{F}$ output in the high level is supplied to an AND gate $G_8$, and when, simultaneously, a signal $EQ_1$ from a = control key hereinafter referred to is supplied to this AND gate $G_8$ through a terminal $T_2$, the $\overline{F}$ output is supplied therethrough to the set terminal S of the flip-flop $FF_1$ to set the same.

The second detecting section C includes detecting circuits $E_1$, $E_2$, $E_3$ and $E_4$ provided respectively for the notes of 10,000-, 5,000-, 1,000- and 500-yen denominations for detecting the denominations of notes specified for dispensation, and a sequence control circuit F. The detecting circuit $E_1$, for detecting dispensation of notes of 10,000-yen denomination, is of such configuration that a high-level signal $T_t$ which is produced when a function key hereinafter referred to is depressed to specify dispensation in notes of 10,000-yen denomination is supplied via an input terminal $T_{21}$ and an AND gate $G_{10}$ to the set terminal S of a flip-flop $FF_{21}$ to set the same. When a low-level locking signal LO is supplied to the other input of the AND gate $G_{10}$ from the locking section D hereinafter described in further detail, the passage of the signal $T_t$ to the flip-flop $FF_{21}$ therethrough is prevented.

The flip-flop $FF_{21}$ when set supplies a high-level F output to one of the inputs of an AND gate $G_{11}$. If, at this time, a high level timing signal $P_3$ is supplied to the other input of the AND gate $G_{11}$ from an input terminal $T_3$, the F output of the flip-flop $FF_{21}$ will be delivered therethrough to the aforesaid OR gate $G_7$ as the instruction signal $RI_{21}$ for the storage circuit $M_{Tt}$ of the storage section A. The high-level F output of the flip-flop $FF_{21}$ will also be supplied to one of the inputs of an AND gate $G_{21}$. If, at this time, the signal $EQ_1$ from the = control key is supplied to the other input of the AND gate $G_{12}$ through the terminal $T_2$, this signal $EQ_1$ will be delivered therethrough to the reset terminal R of the flip-flop $FF_{21}$ to reset the same.

In the other detecting circuits $E_2$ to $E_4$ of the second detecting section C, there are supplied signals $F_t$, $O_t$ and $F_h$, respectively, which are produced when function keys are depressed by the operator to specify dispensation in notes of 5,000-, 1,000- and 500-yen denominations. In response to these signals, the instruction signals $RI_{22}$, $RI_{23}$ and $RI_{24}$ are produced respectively by the detecting circuits $E_2$ to $E_4$ for the storage circuits $M_{Ft}$, $M_{Ot}$ and $M_{Fh}$ of the storage section A. Further, instead of the supply of the timing signal $P_3$ to the AND gate $G_{11}$ in the detecting circuit $E_1$, sequence signals $Q_1$, $Q_2$ and $Q_3$ are supplied from the sequence control circuit F to the AND gate $G_{11}$ of the other detecting circuits $E_2$ to $E_4$. Furthermore, the instruction signals $RI_{22}$ to $RI_{24}$ produced by these detecting circuits $E_2$ to $E_4$ are delivered to the corresponding storage circuits of the storage section A via AND gates $G_{13}$ which are opened when simultaneously supplied with the timing signal $P_3$ from the input terminal $T_3$. Other details of configuration and operation of the detecting circuits $E_2$ and $E_4$ follow suit after those previously set forth in connection with the detecting circuit $E_1$, so that like parts are designated by like reference characters throughout all these detecting circuits $E_1$ to $E_4$.

Figure 3:
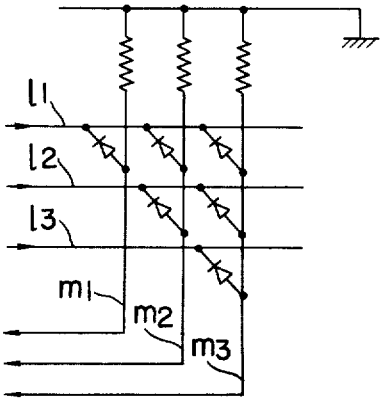
FIG. 3 is a schematic diagram showing in greater detail the configuration of a sequence control circuit shown in FIG. 1.

As illustrated in detail in FIG. 3, the sequence control circuit F included in the second detecting section O is in the form of a diode matrix, including lines $l_1$, $l_2$ and $l_3$ to which are supplied the $\overline{F}$ outputs of the flip-flops $FF_{21}$ of the detecting circuits $E_1$ to $E_3$, and lines $m_1 m_2$ and $m_3$ provided correspondingly to the storage circuits circuits $M_{Ft}$, $M_{Ot}$ and $M_{Fh}$. Thus, when the flip-flops $FF_{21}$ of the detecting circuits $E_1$ to $E_3$ are reset, high-level outputs are obtained in the lines $m_1$ to $m_3$. These outputs are supplied to the AND gates $G_{11}$ of the detecting circuits $E_2$ to $E_4$ as gate-opening signals $Q_1$, $Q_2$ and $Q_3$. On the other hand, when the flip-flops $FF_{21}$ of the detecting circuits $E_1$ to $E_3$ are set, low-level outputs are obtained in the lines $m_1$ to $m_3$, so that the AND gates $G_{11}$ of the detecting circuits $E_2$ to $E_4$ are now closed.

Figure 1:
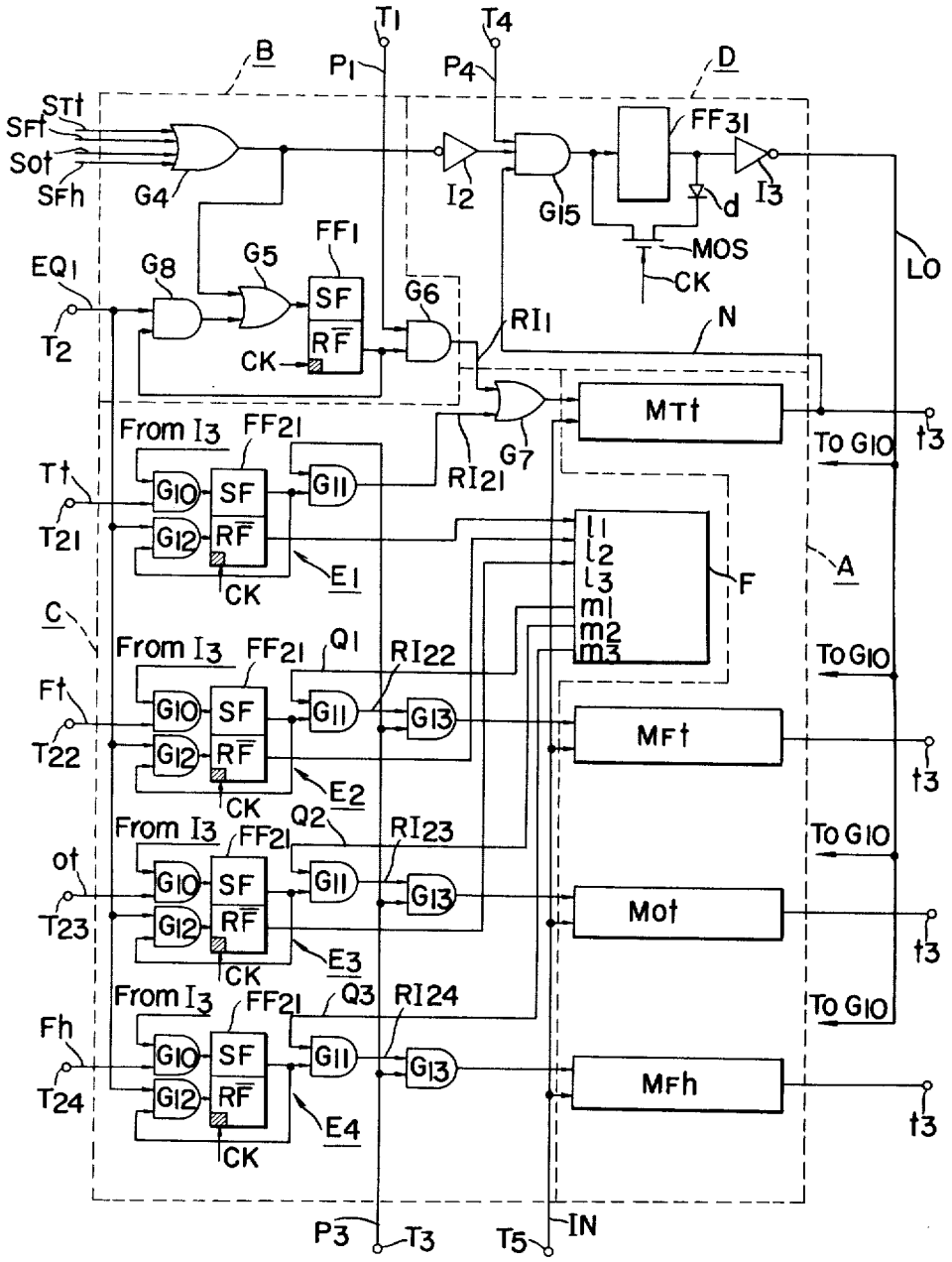
FIG. 1 is a circuit diagram of a preferred embodiment of the invention.

In the locking section D shown in FIG. 1, when the output supplied from the OR gate $G_4$ of the first detecting section B to an AND gate $G_{15}$ via an inverter $I_2$ is in its low level, that is, when no particular denominations of notes have been specified for dispensation, a clock signal $P_4$ supplied from an input terminal $T_4$ will open this AND gate $G_{15}$ to permit the passage therethrough of an output signal N of the storage circuit $M_{Tt}$ of the storage section A to the set terminal of a flip-flop $FF_{31}$. The high-level output from the thus-set flip-flop $FF_{31}$ is, on the one hand, delivered via an inverter $I_3$ as the low-level locking signal LO and, on the other hand, fed back to its set terminal via a diode *d* and a metal-oxide semiconductor transistor MOS. Thereafter, the locking section D remains self-holding in the condition wherein the low-level locking signal LO is produced. When the money dispensing machine has completed dispensation of a desired amount of money, a release signal CK is produced by suitable means to release the locking section D from its self-holding condition by turning off the transistor MOS. Simultaneously, the flip-flop $FF_1$ of the first detecting section B and the flip-flops $FF_{21}$ of the second detecting section C return to their initial inoperative conditions.

Although not shown in the drawings, it is assumed that the timing signals $P_1$, $P_3$ and $P_4$ are produced by known means in a manner well calculated to accomplish the objects of this invention.

To cause the money dispensing machine incorporating the above described system of the invention to dispense a certain amount of money in a minimum number of notes available, digit keys (not shown) are depressed in accordance with the amount of money to be dispensed, and then the = control key is depressed. Since now the signals $S_{Tt}$, $S_{Ft}$, $S_{Ot}$ and $S_{Fh}$ are not supplied to the OR gate $G_4$ of the first detecting section B, a high-level input signal is delivered to one of the inputs of the AND gate $G_{15}$ of the locking section D, so that this AND gate $G_{15}$ will be opened when the timing signal $P_4$ is supplied from the terminal $T_4$. Further, since the signals $S_{Tt}$, $S_{Ft}$, $S_{Ot}$ and $S_{Fh}$ are not produced as aforesaid, the flip-flop $FF_1$ is in its reset condition. Therefore, upon application of the timing signal $P_1$ to the AND gate $G_6$, there is produced the instruction signal $RI_1$ for the storage circuit $M_{Tt}$ of the storage section A. In this condition an input IN representative of the amount of money to be dispensed, which is produced upon depression of the digit keys, is supplied from the terminal $T_5$ to the storage circuit $M_{Tt}$.

The signal N resultantly produced by the storage circuit $M_{Tt}$ is delivered via the now-open AND gate $G_{15}$ to the flip-flop $FF_{31}$ to set the same, so that the locking section D will produce the locking signal LO which functions to close the AND gates $G_{10}$ of all the detecting circuits $E_1$ to $E_4$ of the second detecting section C. Consequently, if the signals $T_t$, $T_t$, $O_t$ and $F_h$ are supplied through the terminals $T_{21}$ to $T_{24}$ by erroneous depression of the function keys which are used to specify dispensation in notes of particular denominations, these signals will be blocked by the AND gates $G_{10}$ of the detecting circuits $E_1$ to $E_4$. In this manner those parts of the circuits which operate when notes of particular denominations are first specified for dispensation are now held inoperative.

If now the = control key is depressed as aforesaid to supply the signal $EQ_1$ to the first detecting section B through the terminal $T_2$, the flip-flop $FF_1$ will thereby be set via the AND gate $G_8$ and the OR gate $G_5$. Therefore, if the digit keys are further depressed to produce the input IN, the information already retained in the storage circuit $M_{Tt}$ will remain unaffected.

To cause the money dispensing machine to dispense a certain amount of money by specifying the notes of 10,000-, 5,000-, 1,000- and 500-yen denominations, the function key for the notes of 10,000- yen denominations is first depressed to specify dispensation in 10,000-yen notes. The digit keys are succeedingly depressed to indicate an amount of money to be dispensed in 10,000-yen notes. The = control key is then depressed. These three operations are repeated for the notes of 5,000-, 1,000- and 500-yen denominations.

Thus, when the function key is depressed as above stated to specify dispensation in 10,000-yen notes, the signal $S_{Tt}$ is supplied to the OR gate $G_4$ of the first detecting section B and, through the procedure previously described, the inverter $I_3$ of the locking section D produces a high-level signal LO, so that the gates $G_{10}$ of all the detecting circuits $E_1$ to $E_4$ of the second detecting section C are now opened. The signal $T_t$ then supplied from the terminal $T_{21}$ sets the flip-flop $FF_{21}$ of the detecting circuit $E_1$ via the AND gate $G_{10}$. Upon application of the timing signal $P_3$ from the terminal $T_3$, the detecting circuit $E_1$ produces its instruction signal $RI_{21}$. The input IN representative of the amount of money to be dispensed in notes of 10,000-yen denomination is now supplied from the terminal $T_5$ to the storage circuit $M_{Tt}$. As the = control key is succeedingly depressed, the signal $EQ_1$ resets the flip-flop $FF_{21}$ of the detecting circuit $E_1$ via the then-open AND gate $G_{12}$, so that the AND gate $G_{11}$ becomes closed. Since then its $\overline{F}$ output level becomes high, the line $m_1$ of the sequence control circuit F, FIG. 3, supplies a high-level signal to open the AND gate $G_{11}$ of the detecting circuit $E_2$. The AND gate $G_{11}$ of the detecting circuit $E_1$ becomes closed because the F output level of its flip-flop $FF_{21}$ now becomes low.

The amounts of money to be dispensed in the specified 5,000-, 1,000- and 500-yen notes are then successively stored in the storage circuits $M_{Ft}$, $M_{Ot}$ and $M_{Fh}$ in a similar manner. In the meantime, the flip-flop $FF_1$ of the first detecting section B is set by the output from the OR gate $G_4$, and the AND gate $G_6$ is resultantly closed, so that the instruction signal $RI_1$ is not supplied from this first detecting section B to the storage section A.

It will be understood that, while in this embodiment of the invention, the amount of money to be dispensed in a minimum number of notes available and that to be dispensed in notes of 10,000-yen denomination are both memorized in one and the same storage circuit $M_{TI}$, two registers can be provided for storing these different pieces of information. Further, instead of the provision of the sequence control circuit F in the second detecting section C, the sequence may be controlled manually, as by supplying a signal for opening the AND gate $G_{11}$ of the corresponding detecting circuit $E_1$, $E_2$, $E_3$ or $E_4$ each time a particular denomination of notes is specified.

Figure 4:
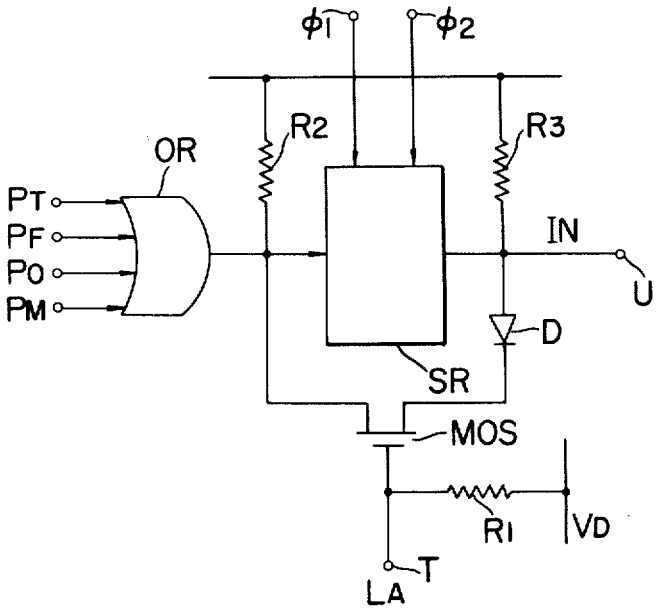
FIG. 4 is a circuit diagram of another preferred embodiment of the invention.

FIG. 4 illustrates another preferred embodiment of the invention designed to make the register of the money dispensing machine unaffected by erroneous operation of its keys on the part of the operator. Signals $P_T$, $P_F$, $P_O$ and $P_M$ consisting of positive pulses produced upon depression of the keys for specification of dispensation in notes of 10,000-, 5,000-, 1,000- and 500-yen denominations, respectively, are supplied through an OR gate OR to a one-bit shift register SR. This shift register consists of a flip-flop composed of the integrated circuit of metal-oxide semiconductor transistors. Its pair of clock inputs are respectively supplied with opposite-phased clock inputs $\phi_1$ and $\phi_2$.

The output of the shift register SR is connected to one end, that is, the drain (or source), of a switching element MOS forwardly through a diode D for feedback purposes, the switching element MOS being formed by a metal-oxide semiconductor transistor. The other end, the source (or drain), of the switching element MOS is connected back to the input of the shift register SR. The control end, the gate, of the switching element MOS may be connected to a negative voltage source $V_d$ via a resistance $R_1$ so that the switching element MOS is always held conductive. However, this switching element is made nonconductive during the application of a release signal $L_A$ through a control terminal T, the release signal $L_A$ being produced in the form of a positive pulse when the = function key is depressed.

Biasing resistances $R_2$ and $R_3$ are connected to the input and the output, respectively, of the shift register SR. Although not shown in the drawing, it is assumed that gate means are positioned between the main register of the machine and the keys which are depressed to specify dispensation in the notes of particular denominations, the gate means being closed by a locking signal IN produced through the output terminal U of the shift register SR.

In the normal inoperative condition of the above-described circuit configuration, the shift register SR is in its reset condition, so that the gate means mentioned in the preceding paragraph are now closed because of the low output level of the shift register. The switching element MOS is now conductive as above mentioned.

If, in this condition, the signal $P_t$ is supplied in a suitable manner into the main register of the money dispensing machine by the depression of the key for the specifying dispensation in the notes of 10,000-yen denomination, this signal will be directed to the shift register SR in the form of a positive pulse. The signal will be introduced into the shift register SR immediately if the clock input $\phi_1$ to the shift register is then in the low level, or as soon as the clock input $\phi_1$ becomes low in level. When the level of the clock input $\phi_1$ succeedingly becomes high, that is, when the level of the clock input $\phi_2$ becomes low, a positive pulse is fed back from the output of the shift register SR to its input via the switching element MOS. When the level of the clock input $\phi_1$ again becomes low, that is, when the level of the clock input $\phi_2$ becomes high, the fedback pulse is stored in the shift register SR. This pulse is again yielded from the shift register SR and fed back to its own input when the level of the clock input $\phi_2$ becomes low.

Thus, if the pulse duration of each of the signals $P_T$, $P_F$, $P_O$ and $P_M$ introduced into the shift register SR is longer than at least half-cycle of the clock input $\phi_1$ or $\phi_2$, each of the signals will be introduced into the shift register by the clock input $\phi_1$, yielded therefrom by the clock input $\phi_2$ while being delayed by one bit, and fed back via the switching element MOS. In this manner, each of the signals is stored dynamically by the shift register SR. During the length of time when the pulse produced at the output of the shift register SR is fed back and again yielded therefrom, the output level of this shift register is held high owing to its capacity. This high output level is delivered from the terminal U as the aforesaid locking signal IN to close the gate means also mentioned previously.

The digit keys may now be depressed to set in the main register of the money dispensing machine the amount of money to be dispensed in the notes of 10,000-yen denomination. As the = function key is succeedingly depressed, the resultantly produced release signal $L_A$ is delivered from the terminal T to the switching element MOS to render the same nonconductive. Since then the feedback path from the output to the input of the shift register SR is broken, the information which has been dynamically stored therein becomes absent. The pulse duration of the release signal $L_A$ is made sufficiently longer than the length of time necessary for the output of the shift register to change from its high to low level. The locking signal IN is no longer produced so that the gate means are opened. The money dispensing machine returns to its initial inoperative condition, ready for the succeeding operation.

If, after depressing the digit keys to indicate the amount of money to be dispensed in the notes of 10,000-yen denomination as above mentioned, the key for specifying dispensation in the notes of 5,000-yen denomination is erroneously depressed without succeedingly depressing the necessary = function key, this will not affect the condition of the shift register SR, in which is retained the information produced when the key for specifying dispensation in the notes of 10,000-yen denomination has been depressed. The signal produced when the key for specifying dispensation in the 5,000-yen notes is blocked by the gate means kept closed, so that the amount of money is to be dispensed in the 5,000-yen notes cannot be set in the main register of the machine.

While it has been stated above that the release signal $L_A$ is produced each time the = function key is depressed, it is also possible, of course, to cause this release signal to be produced each time a required number of the digit keys have been depressed to indicate an amount of money to be dispensed in the notes of precedingly specified dispensation.

We claim:

1. In combination with a money dispensing machine of the type which receives data representative of separate amounts of money respectively corresponding to separate monetary denominations desired to be dispensed, and which dispenses money of said desired denominations in accordance with the corresponding separate amounts of money specified, an improvement which comprises:

means for selectively designating denominations of money to be dispensed and for providing denomination input signals indicative thereof;

denomination detecting means for detecting said denomination input signals and for producing denomination output signals indicative of which of said monetary denominations are desired to be dispensed, said denomination detecting means including means for storing said denomination input signals until after said data representative of said separate amounts of money desired to be dispensed of each of said monetary denominations has been specified whereupon detection output signals are produced therefrom;

sequence control means connected to receive said detection output signals from said denomination detecting means for producing sequence signals which specify a predetermined order of money denomination dispensation;

storage means including a plurality of storage circuits, one for each denomination, for storing said data representative of said amount of money of said corresponding denomination desired to be dispensed; and gating means responsive to said denomination output signals and to said sequence signals for producing gating signals which successively gate each of said plurality of storage circuits which correspond to desired monetary denominations to enable said storage circuits to receive the corresponding money amount data therein.

2. In combination with a money dispensing machine of the type which selectively dispenses a desired amount of money in operator-specified denominations or with a minimum number of monetary pieces, a control system therefor which comprises:

first storage means for storing information representative of an amount of money when said amount of money is desired to be dispensed with a minimum number of monetary pieces;

second storage means for storing information representative of an amount of money when said amount of money is desired to be dispensed in operator-specified denominations;

first detection means for detecting whether or not monetary denominations have been specified for dispensing said desired amount of money and, when monetary denominations have not been specified, for causing said first storage means to store information representative of said desired amount of money;

second detection means for detecting when monetary denominations have been specified for dispensing said desired amount of money and for causing said second storage means to store information representative of said desired amount of money; and locking means which, when said first detection means has detected that said desired amount of money is to be dispensed with specified monetary denominations, is actuated by said first detection means for prohibiting the operation of said second detection means so that the application of said information representative of said desired amount of money to said second storage means through said second detecting means is prohibited.

3. In combination with a money dispensing machine of the type which stores data representative of separate amounts of money respectively corresponding to separate monetary denominations specified, and which dispenses said separate amounts of money, data input control means therefor, which comprises:

denomination detecting means for selectively specifying denominations of amounts of money to be dispensed and for continuing the production of a denomination signal representative of a denomination thus selectively specified until data on an amount of money to be dispensed has been specified;

sequence control means which, even when a plurality of denominations have been selected by said denomination detecting means, selectively provides a denomination signal representative of only one denomination;

money amount specifying means for specifying separate amounts of money with respect to separate denominations and for producing separate money amount signals representative of said separate amounts of money;

storage means comprising separate storage circuits provided respectively for said separate denominations so that data on said separate amounts of money are stored separately in said separate storage circuits; and a gate circuit which, based on a denomination signal selected by said denomination detecting means and said sequence control means, applies said data representative of said separate amounts of money specified by said money amount specifying means respectively to said storage circuits of said storage means provided respectively for said monetary denominations.

* * * * *